US008968162B2

(12) United States Patent
Jaguan

(10) Patent No.: US 8,968,162 B2
(45) Date of Patent: Mar. 3, 2015

(54) ROTARY ARM/LEG EXERCISER

(71) Applicant: Mauro Jaguan, Caracas (VE)

(72) Inventor: Mauro Jaguan, Caracas (VE)

( * ) Notice: Subject to any disclaimer, the term of this patent is extended or adjusted under 35 U.S.C. 154(b) by 147 days.

(21) Appl. No.: 13/655,388

(22) Filed: Oct. 18, 2012

(65) Prior Publication Data

US 2014/0113776 A1 Apr. 24, 2014

(51) Int. Cl.
*A63B 22/06* (2006.01)
*A63B 69/16* (2006.01)
*A63B 22/12* (2006.01)

(52) U.S. Cl.
USPC ..... 482/57; 482/62; 482/63

(58) Field of Classification Search
CPC ..... A63B 22/00; A63B 22/0002; A63B 22/0007; A63B 22/001; A63B 22/0012; A63B 22/0046; A63B 22/06; A63B 22/0605
USPC ..... 482/51, 57–59, 62–65
See application file for complete search history.

(56) References Cited

U.S. PATENT DOCUMENTS 4,140,312 A * 2/1979 Buchmann ..... 482/62
4,225,130 A * 9/1980 Zimmerman ..... 482/60
4,358,109 A * 11/1982 Schrems ..... 482/142
4,881,732 A * 11/1989 Kepiro ..... 482/62
4,902,002 A * 2/1990 Huang ..... 482/62
5,039,092 A * 8/1991 Olschansky et al. ..... 482/130
5,044,627 A * 9/1991 Huang ..... 482/62
5,160,305 A * 11/1992 Lin ..... 482/138
5,269,736 A * 12/1993 Roberts ..... 482/62
5,330,402 A * 7/1994 Johnson ..... 482/62
5,514,053 A * 5/1996 Hawkins et al. ..... 482/63
5,569,128 A * 10/1996 Dalebout ..... 482/57
5,857,943 A * 1/1999 Murray ..... 482/57
6,036,623 A * 3/2000 Mitchell ..... 482/57
6,592,498 B1 * 7/2003 Trainor ..... 482/97
7,510,512 B1 * 3/2009 Taggett ..... 482/62
7,621,852 B2 11/2009 Bowser
7,789,808 B2 * 9/2010 Lee ..... 482/62
8,636,628 B1 * 1/2014 Greene et al. ..... 482/57
2005/0054499 A1 * 3/2005 Davies, III ..... 482/131
2005/0266964 A1 * 12/2005 Teng ..... 482/71
2007/0197350 A1 * 8/2007 Gonzalez ..... 482/83
2008/0234112 A1 * 9/2008 Hernandez ..... 482/63

* cited by examiner

*Primary Examiner* — Stephen Crow
*Assistant Examiner* — Garrett Atkinson
(74) *Attorney, Agent, or Firm* — William Lovin & Assoc., LLC

(57) ABSTRACT

The present invention provides a compact, unitary exercise machine which may be rapidly reconfigured such that the user can perform a variety of exercise routines employing essentially the same rotary exercise movement, whether using the legs or the arms, while simultaneously exercising all the muscles of the subject extremity, including antagonistic muscles.

4 Claims, 5 Drawing Sheets

ROTARY ARM/LEG EXERCISER

CROSS-REFERENCE TO RELATED APPLICATIONS

This application takes benefit of U.S. Provisional Appl. No. 61/548,517 which is incorporated in its entirety by reference.

FIELD OF THE INVENTION

The present disclosure relates to an exercise device used to strengthen the user's arms and shoulders and legs and buttocks.

BACKGROUND OF THE INVENTION

Exercise machines come in almost countless varieties, sizes, and designs. A typical exercise studio is usually equipped with machines that are purpose built, i.e. one machine for exercising biceps and shoulders, another machine for triceps, and analogous machines to strengthen the user's quadriceps femoris and rectus femoris, and so on. Numerous integrated machines have been designed that attempt to exercise all of these muscle groups. However, these machines require that the user radically reposition his or her body with respect to the machine (e.g. lay on one's back and then turn over to lay on one's abdomen to adequately exercise antagonistic muscles) and then engage in a completely different exercise targeted at different specific muscles or group of muscles. Machines have been disclosed that attempt to solve the foregoing problem but do so inadequately, e.g. a stationary bicycle. While the user assumes only one position with respect to the bicycle, the exercise thus accomplished (i.e. pedaling) affects only the legs and buttocks but does little to exercise the arms and shoulders.

BRIEF DESCRIPTION OF THE INVENTION

It is an object of the present invention to provide a compact, unitary exercise machine in which: 1) The user is not required to radically reposition his or her body with respect to the machine; 2) The user performs essentially the same rotary exercise movement, whether it be with the legs or the arms; and, 3) Adequately exercises all the muscles of the subject extremity, including antagonistic muscles.

The present invention is generally comprised of a hollow vertical pole with a variable height seat unit attached to the top of a parallel pair of seat support arms that are in turn attached at right angles to the vertical pole by means of a vertically adjustable seat support sleeve. The seat has an adjustable, reclinable back and is attached at the distal end of the seat support arms where the arms and the seat are supported by a telescoping seat support unit. The seat support arms may be adjusted forward and backward with respect to the vertical pole and the telescoping seat support unit and seat support sleeve may be adjusted up and down with respect to the vertical pole to position the seat at a specific distance from the vertical pole or at any height with respect to the vertical pole including in close proximity to the floor.

Attached to the vertical pole above the seat unit and seat support arms are a pair of parallel rotor support arms. These rotor support arms are similarly attached at right angles to the vertical pole by means of a vertically adjustable rotor support sleeve. Attached to the distal end of these rotary support arms is a resistance wheel yoke. A resistance wheel with a central axle is mounted in the resistance wheel yoke. The resistance wheel has two diametrically oriented crank arms one attached at each end of the axel. At the end of each crank arm a handle attachment point is mounted so that its axis is perpendicular to the central axis of the respective crank arm. A variety of handles may be attached to the handle attachment points, including a horizontally oriented handle that serves both as a handgrip and as a pedal with foot retaining strap. A "T" shaped handle may be attached to the crank arm also. The "T" handle causes the user to turn the hand and arm 90° to grasp it. The rotor support arms may be adjusted forward and backward with respect to the vertical pole and the rotor support sleeve may be adjusted up and down with respect to the vertical pole to position the resistance wheel at a specific distance from the vertical pole or at any height with respect to the vertical pole.

The invention may be used in a variety of ways. First, the seat and seat support rails may be pulled out to their furthest extent and dropped to the floor. Next, the rotary resistance unit may be pushed towards the vertical pole and the rotor support arms may be dropped to their lowest position. Next, the seat is reclined back to a 45° angle. Two resistance bands each with a handle are attached higher on the vertical pole. When equipped this way the user sits in the seat, places his/her feet on the horizontally oriented handles adapted for use as handles or pedals with foot retaining straps, grasps the handles of the resistance bands, reclines in the seat, and begins pedaling and rhythmically stretching the resistance bands. By this means the user achieves a sensation like riding a stationary bicycle. Second, the seat and seat support rails may be raised to a convenient seating height, the rotary resistance unit and rotor support arms may be raised to the level of the user's shoulders when seated on the seat, and the seat is reclined to a 90° angle. When equipped this way the user sits in the seat places his/her hands on the horizontally oriented handles adapted for use as handles or pedals with foot retaining straps, and begins rotating the rotary resistance unit. Third, the user places a seat extension board on the top of the seat support rails, reclines the seat fully back so that it is co-planar with the seat and seat extension board so that the seat back, seat, and seat extension board form a bench, and then adjusts the seat, seat extension board, and seat support rails to a height where the user's feet firmly rest on the floor when the user lays on his/her back on the seat and seat extension board. The rotary resistance unit and rotor support arms may be raised to a point about a foot above the user when laying on the seat and seat extension board. When equipped this way the user lays on his/her back on the seat and seat extension board, places his/her hands on the horizontally oriented handles adapted for use as handles or pedals with foot retaining straps, and begins rotating the rotary resistance unit. Fourth, the user removes the seat extension board, reclines the seat fully back so that it is co-planar with the seat support, and the seat and seat support rails are dropped to the floor. The rotary resistance unit and rotor support arms are raised to a point about a foot above the user's head when standing on the floor straddling the seat support bars. When equipped this way the user stands straddling the seat support bars, places his/her hands up to grasp the horizontally oriented handles adapted for use as handles or pedals with foot retaining straps, and begins rotating the rotary resistance unit. Each of the above configurations exercises a different group of muscles. Many other orientations exercising different groups of muscles will be readily apparent to those having skill in the applicable arts.

DETAILED DESCRIPTION OF THE INVENTION

Figure 1:
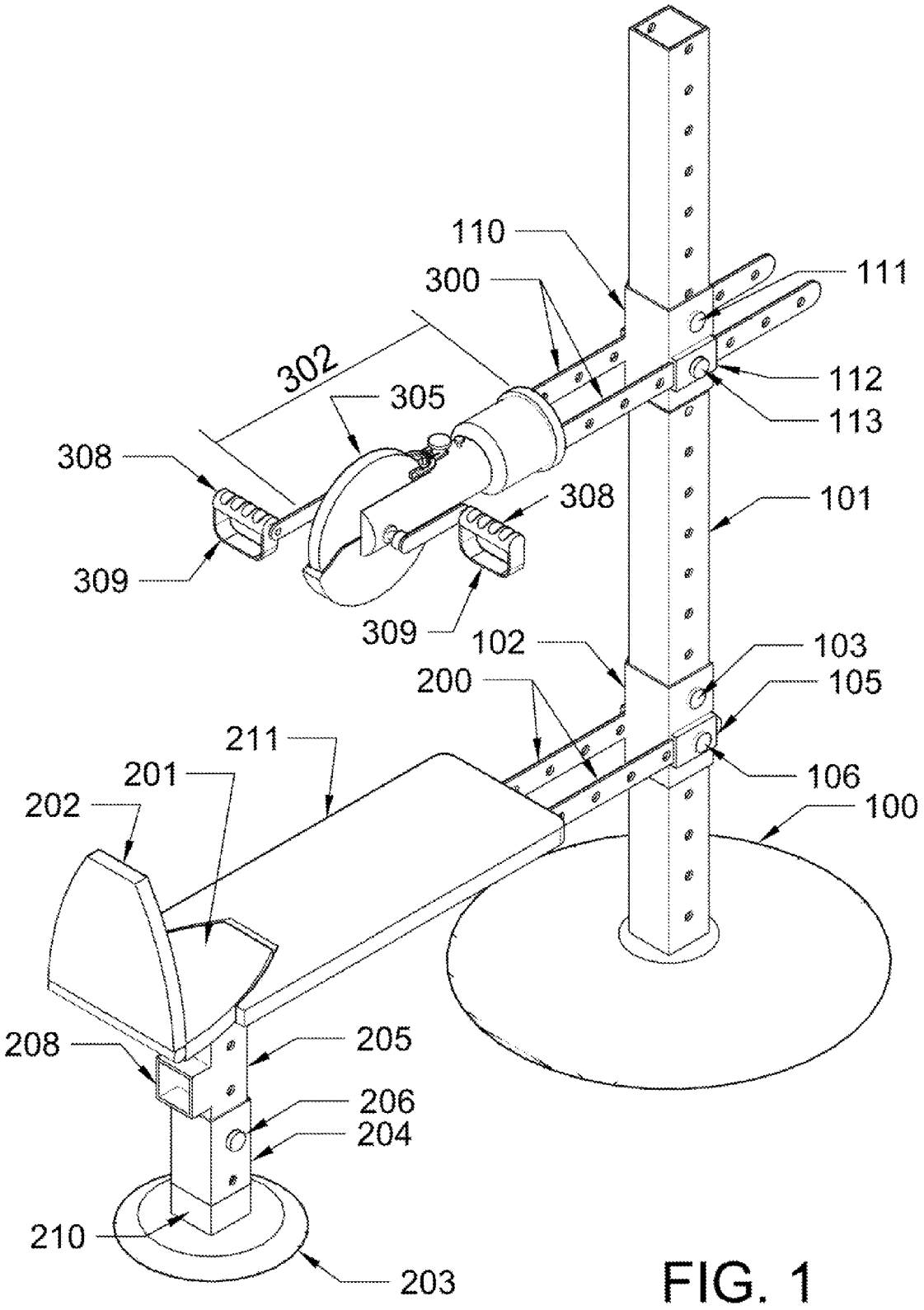
FIG. 1 is an oblique view of the present invention assembled and configured in a first exercise position in which the user is seated on the present invention.
Figure 2:
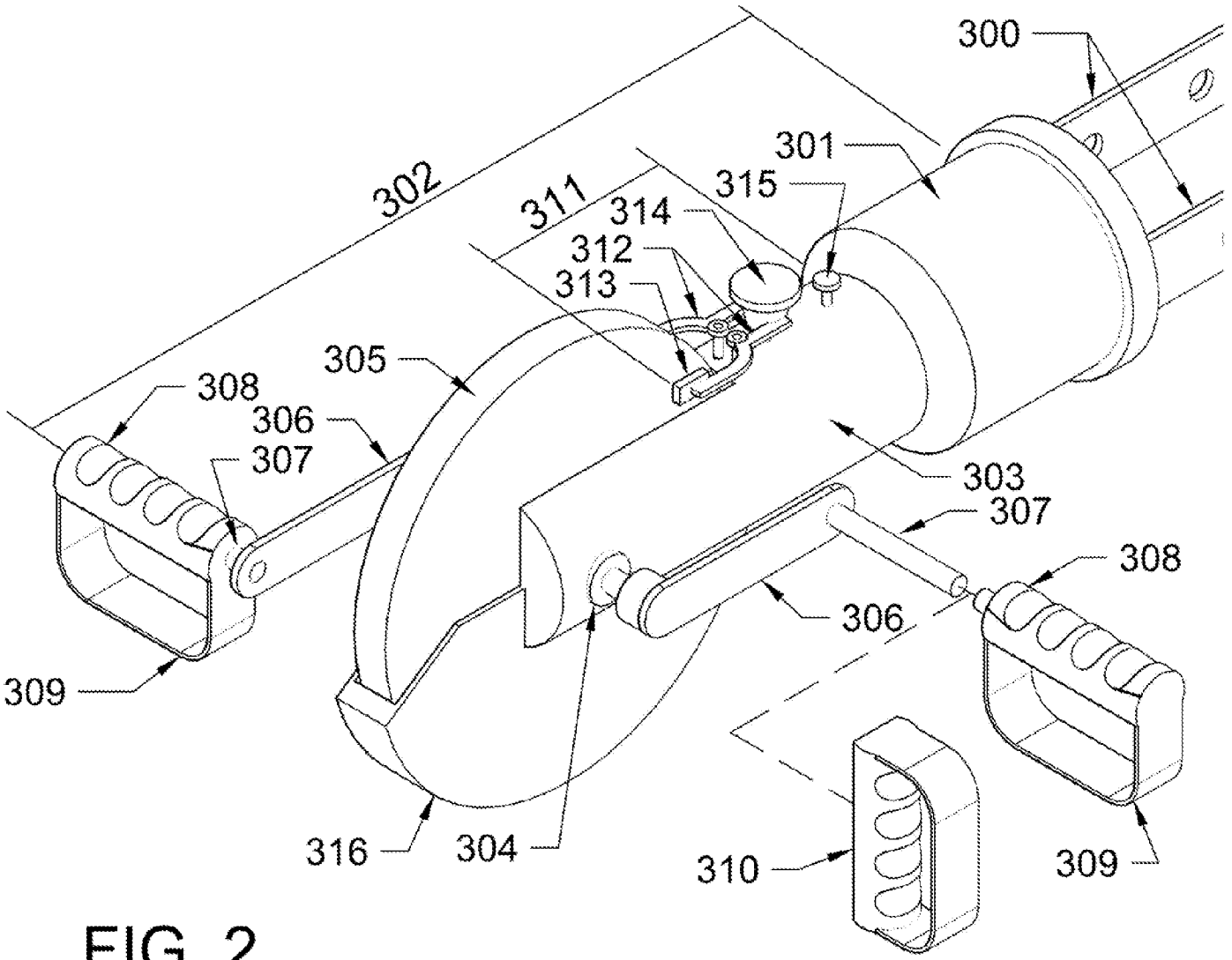
FIG. 2 is a view of the support arm, "Y" shaped support yoke, and rotary resistance unit of the present invention showing two types of handles used with the rotary resistance unit.
Figure 3:
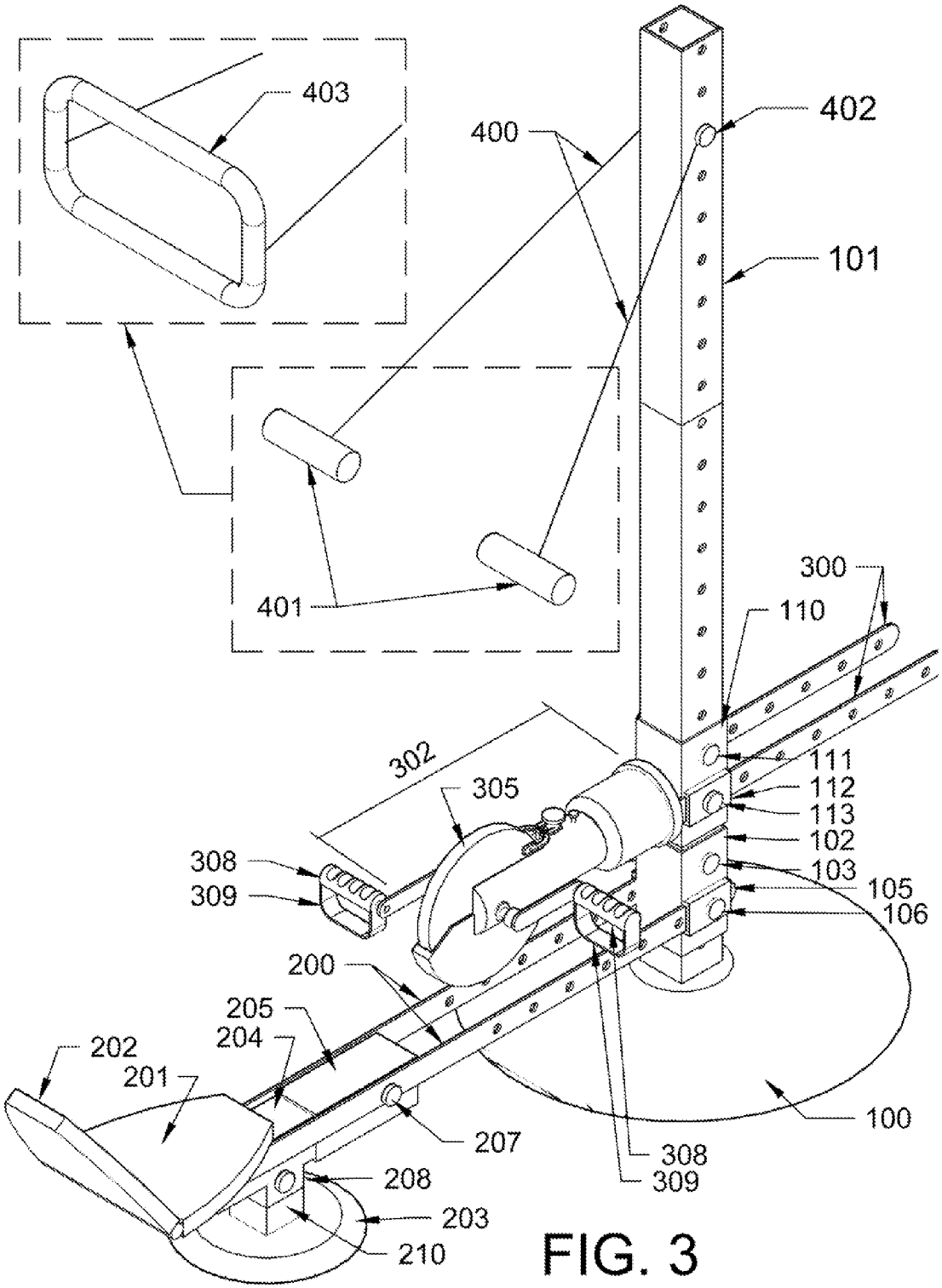
FIG. 3 is an oblique view of the present invention assembled and configured in a second exercise position in which the user reclines on the present invention.

Referring now to FIGS. 1, 2, and 3, the present invention is comprised of a rectangular or circular base unit 100, with a hollow vertical pole 101 attached perpendicular to the base unit. Vertical pole 101 is perforated by holes at regular intervals such that the center point of any one hole on the left side is at the same height from the surface of base unit 100 as is a corresponding hole on the right side.

Sliding down over vertical pole 101 is a seat support arm support sleeve 102. Seat support arm support sleeve 102 may be fixed at any convenient height by means of a first through pin 103 that slides though holes formed on either side of seat support arm support sleeve 102 and the through holes in vertical pole 101. On the left and right sides of seat support arm support sleeve 102 below the hole through which first through pin 103 slides, are seat support arm mounting channels 105. Seat support arm mounting channels 105 are shaped and sized to allow the user to securely slide one of seat support arms 200 through each of them. Seat support arm support sleeve 102 has a second set of through holes drilled on both sides through seat support arm mounting channels 105 and the underlying interior sides of seat support arm support sleeve 102 so that seat support arm support sleeve 102 may be positioned to coincide with a set of through holes in vertical pole 101.

Seat 201 with a back rest 202 fixedly reclinable in a variety of angles is attached to one end of each of two equal length parallel seat support arms 200. Both of seat support arms 200 are perforated at regular intervals along their length such that the center point of any one hole on left seat support arm 200 is at the same distance from either end of left seat support arm 200 as a corresponding hole on right seat support arm 200 is from either end of right seat support arm 200. The ends of seat support arms 200 opposite seat 201 are positioned such that one passes through each of seat support arm mounting channels 105 thus straddling seat support arm support sleeve 102 and vertical pole 101. Seat support arms 200 are affixed to vertical pole 101 by means of second through pin 106 that slides through both of seat support arm mounting channels 105, left and right seat support arms 200, the underlying interior sides of seat support arm support sleeve 102, and vertical pole 101. By removing second through pin 106 the user can move seat support arms 200 forward or backward and adjust the distance that seat 201 is located from vertical pole 101. Similarly, by removing the first through pin 103 and second through pin 106 the user can move seat support arm support sleeve 102 up and down vertical pole 101.

Seat 201 is supported by a telescoping seat support unit. The telescoping seat support unit is comprised of a rectangular or circular seat base 203, seat base tube 204, and telescoping seat tube 205. The top of seat base 203 is equipped with a base tube mounting sleeve with mounting flange 210 so that seat base tube 204 may be slid perpendicularly down over it to attach seat base tube 204 to seat base 203. Seat base tube 204 and telescoping seat tube 205 are perforated by holes at regular intervals along their lengths and are slidably fixable with respect to each other by means of third through pin 206 that passes through these holes when aligned with each other. By this means, the height of the telescoping seat support unit, and thus seat 201, may be conveniently adjusted. Seat extension board 211 may be placed on top of seat support arms 200 between seat 201 and seat support arm support sleeve 102. Seat extension board 211 has longitudinal grooves in its back so that the back of seat extension board 211 slips over the respective top edges of seat support arms 200 and is locked in place. One end of telescoping seat tube 205 is hingedly attached between seat support arms 200 underneath seat 201 so that when telescoping seat tube 205 is slidably fixed to seat base tube 204, both telescoping seat tube 205 and affixed seat base tube 204 stow away by swinging them up and between parallel seat support arms 200. The stowed telescoping seat tube 205 and seat base tube 204 are secured in the stowed condition by installing a fourth through pin 207 that slides through seat support arms 200 and seat base tube 204. When telescoping seat tube 205 and seat base tube 204 are secured in the stowed position, seat base sleeve 208 affixed to the downward facing aspect of telescoping seat tube 205 may be slid perpendicularly down over the mounting flange of base tube mounting sleeve 210 to attach seat base sleeve 208 to seat base 203 thus allowing seat 201 to be supported by seat base 203. This latter configuration is used when seat support arms 200 are fastened to vertical pole 101 at their lowest level.

Also sliding over vertical pole 101 is rotor support arm support sleeve 110. Rotor support arm support sleeve 110 may be fixed at any convenient height by means of a fifth through pin 111 that slides though holes formed on either side of rotor support arm support sleeve 110 and underlying through holes in vertical pole 101. On the left and right sides of rotor support arm support sleeve 110 below the hole through which fifth through pin 111 slides, are rotor support arm mounting channels 112. Rotor support arm mounting channels 112 are shaped and sized to allow the user to securely slide one of rotor support arms 300 through them. Like seat support arm support sleeve 102, rotor support arm support sleeve 110 has a second set of through holes drilled on both sides through rotor support arm mounting channels 112 and the underlying interior sides of rotor support arm support sleeve 110 so that rotor support arm support sleeve 110 may be positioned to coincide with a set of through holes in vertical pole 101.

Rotor support head 301 is attached to one end of each of two equal length parallel rotor support arms 300. Both of rotor support arms 300 are perforated at regular intervals along their length such that the center point of any one hole on left rotor support arm 300 is at the same distance from either end of left rotor support arm 300 as the corresponding hole on right rotor support arm 300 is from either end of right rotor support arm 300. The ends of rotor support arms 300 opposite support head 301 are positioned to straddle rotor support arm support sleeve 110 while passing through rotor support arm mounting channels 112. Rotor support arms 300 are affixed to vertical pole 101 by means of a sixth through pin 113 that slides through both rotor support arm mounting channels 112, left and right rotor support arms 300, the underlying portions of rotor support arm support sleeve 110, and vertical pole 101. By removing sixth through pin 113 the user can move rotor support arms 300 forward or backward and adjust the distance of rotary resistance unit 302 with respect to vertical pole 101. Similarly, by removing fifth through pin 111 and sixth through pin 113 the user can move rotor support arm support sleeve 110 up and down vertical pole 101.

Attached to the front surface of rotor support head 301 is "Y" shaped support yoke 303. "Y" shaped support yoke 303 is attached to rotor support head 301 at the base of the "Y" and is further aligned perpendicular to the front surface of rotor support head 301 when viewed from the left or the right side of rotor support head 301 and when viewed from the top or the bottom of rotor support head 301. The distal ends of the two arms of "Y" shaped support yoke 303 are aligned such that a line proceeding from the left unattached distal end to the right unattached distal end runs perpendicular to the vertical pole and parallel to the ground. Inserted through a hole drilled or otherwise formed in "Y" shaped support yoke 303 at each of its unattached distal ends is circular bearing 304. Both of bearings 304 are aligned so that a line proceeding from the rotational center point of left bearing 304 to the rotational center point of right bearing 304 runs perpendicular to vertical pole 101 and parallel to the ground. "Y" shaped support yoke 303 and rotor support head 301 are connected such that "Y" shaped support yoke may be rotated 360° with respect to rotor support head 301 so that rotary resistance unit 302 may be positioned so that crank arms 306 and resistance wheel 305 rotate in any plane varying from perpendicular with respect to the ground to horizontal with respect to the ground back to perpendicular with respect to the ground. Rotary resistance unit 302 may be locked and used at any angle by means of a set screw 315 or a pin or a clamp.

The aforementioned resistance wheel 305 is located equidistant between the arms of "Y" shaped support yoke 303. Resistance wheel 305 has a central axle which passes through left and right bearings 304 and extends a short distance to the left and right, respectively, beyond them. Affixed to both of the unattached left and right distal ends of the axle are left and right crank arms 306, respectively. Each of crank arms 306 are affixed at right angles with respect to the central rotational axis of the axle passing through resistance wheel 305. Crank arms 306 are further aligned such that the unattached distal ends of crank arms 306 are diametrically opposed when viewed from the left or the right side of the rotary resistance unit. Affixed to the unattached distal end of each of crank arms 306, and at a right angle to the long axis of each of said crank arms 306, is a short axle bar 307. Axle bars 307 are further aligned such that: 1) The central axis of left axle bar 307 extends to the left and perpendicular to the plane described by left crank arm 306 as it rotates; and, 2) The central axis of right axle bar 307 extends to the right and perpendicular to the plane described by right crank arm 306 as it rotates. Axle bars 307 may be optionally equipped with interchangeable slide-on combination handles/pedals 308 with retaining straps 309 or "T" shaped alternative handles 310. By changing handles and modes of use the user can prepare rotary resistance unit 302 to exercise the arms or legs in a variety of different ways. Resistance wheel 305 is partially or wholly covered by a protective shroud 316.

Affixed to the top of the non-bifurcated base portion of "Y" shaped support yoke 303 is a user adjustable means of varying the force required to rotate resistance wheel 305. In this embodiment, friction brake caliper 311 serves this function. Brake caliper 311 has two spring loaded arms 312 each one of which extends over a different side of resistance wheel 305 and terminates near the circumferential periphery of resistance wheel 305. Attached to the end of each spring loaded arm 312 is friction pad 313, composed of a fibrous material such as felt or rubber, nylon, or plastic oriented in such a way that friction pads 313 contact the circumferential periphery of resistance wheel 305 when brake caliper 311 is tightened. The resistive force brake caliper 311 and friction pads 313 apply to resistance wheel 305 is adjusted by means of adjustable screw actuator 314. Adjustable screw actuator 314 is equipped with an inverted truncated cone cam surface such that as it is screwed down on its central threaded shaft, it causes the gap between friction pads 313 to narrow, thus causing friction pads 313 to more firmly impinge on the circumferential periphery of resistance wheel 305. As adjustable screw actuator 314 is unscrewed, spring loaded arms 312 and friction pads 313 are automatically withdrawn from the circumferential periphery of resistance wheel 305. By this means, the amount of force required to rotate resistance wheel 305 may be steadily increased or decreased.

Those skilled in the art will appreciate that numerous other alternative mechanical arrangements may be created which provide a user adjustable means for applying variable friction to resistance wheel 305 wherein the aforementioned friction pads 313 impinge on other aspects of resistance wheel 305, such as the circumferential edge of resistance wheel 305, the central aspects of the sides of resistance wheel 305, or even the axle of resistance wheel 305 and that all such equivalent arrangements are included in the spirit and scope of the present invention. Similarly, friction brake caliper 311 may be actuated by a limitless number of alternative mechanical arrangements and that all such equivalent arrangements are also included in the spirit and scope of the present invention Similarly, resistance wheel 305, friction brake caliper 311, and friction pads 313 may collectively be altered or even replaced with any one of a number of equivalent arrangements for varying the force required to rotate crank arms 306 including without limitation: 1) An adjustable pitch fan; 2) A resistance wheel 305 with one or more peripherally mounted magnets that interact with one or more moveable magnets mounted on "Y" shaped yoke 303 whereby the force necessary to spin resistance wheel 305 increases as the moveable magnet(s) are progressively adjusted to lie closer to the peripherally mounted magnet(s) on resistance wheel 305; and, 3) A fluid resistance unit with a variable pitch impeller rotating in a sealed, fluid-filled case. All such equivalent arrangements are included in the spirit and scope of the present invention.

The present invention is equipped with slide on handle and pedal accessories for attachment to axle bars 307. Combination handle/pedal 308 is a convertible gripping and pushing handle/pedal with a retaining strap 309. Combination handle/pedal 308 is constructed such that side of combination handle/pedal 308 opposite retaining strap 309 is grooved to comfortably accommodate the user's hand and fingers. The side on which retaining strap 309 is located is flat so the foot may be inserted between the flat part of combination handle/pedal 308 and retaining strap 309 and used as a pedal allowing the user to push and pull combination handle/pedal 308 with the leg so that the leg may be exercised both on the downstroke and on the upstroke. Alternative handle 310 is "T" shaped so that the hands may be turned 90° and the arms and shoulders exercised accordingly.

The device further comprises various resistance bands 400. Ordinarily, one end of each resistance band 400 is constructed with a "T" handle 401 or stirrup while the other end is equipped with a means of attaching the resistance band 400 to the vertical pole, such as a hook, spring loaded clip, or pin 402. In one embodiment, two resistance bands 400 are both connected to a unitary handle or gripping loop 403 while the other end of each resistance band 400 is equipped with a means of attaching resistance band 400 to the vertical pole, such as a hook, spring loaded clip, or pin 402.

The user can make use of the exerciser in a variety of ways, including but not limited to, sitting use, recumbent use, supine use, and standing use.

Referring specifically to FIGS. 1 and 2, to use the machine in a seated position, the user places one of the aforementioned combination handle/pedals 308 or alternative handles 310 on each of axle bars 307. Next, the user places seat support arm support sleeve 102, seat support arms 200, and seat 201 to a comfortable seat height so that rotary resistance unit 302 is in front of the user's shoulders when seated on seat 201. The user does this by: 1) Removing first and second through pins 103 and 106 thus allowing seat 201 to be raised to a comfortable seat height; 2) Replacing first and second through pins 103 and 106; 3) Unpinning and positioning the aforementioned swinging, telescoping seat tube 205 and seat base tube 204 in the down position (if not already down); 4) Adjusting the length of seat base tube 204 and telescoping seat tube 205 to the proper length to support seat 201, and, 5) Placing seat base tube 204 perpendicularly down over the mounting flange of base tube mounting sleeve 210 to attach seat base tube 204 to seat base 203 thus allowing seat 201 to be supported by seat base 203. Next, the user sets the angle of seat back 202 to 90°. Next, the user: 1) Removes fifth and sixth through pins 111 and 113 thus allowing rotary resistance unit 302 to be positioned at shoulder height and approximately 18" in front of the user when the user is seated; and, 2) Replaces fifth and sixth through pins 111 and 113. Next, the user adjusts the tension on rotary resistance unit 302 to the desired level. Next the user sits on seat 201 and grips combination handle/pedals 308. The user then exercises the muscles of his arms, shoulders, chest, and back by rotating the resistance wheel 305.

Referring specifically to FIGS. 2 and 3, to use the machine in a recumbent position, the user places one of the aforementioned combination handle/pedals 308 on each of said axle bars 307. Next, the user drops seat support arm support sleeve 102, seat support arms 200, and seat 201 to their lowest position by: 1) Positioning and pinning the aforementioned swinging, telescoping seat tube 205 and seat base tube 204 up and out of the way into the space between the aforementioned parallel seat support arms 200 (if not already stowed); 2) Removing first and second through pins 103 and 106 thus allowing seat 201 to be lowered to the level of base unit 203; 3) Replacing first and second through pins 103 and 106; and, 4) Placing seat base sleeve 208 perpendicularly down over the mounting flange of base tube mounting sleeve 210 to attach seat base tube 204 to seat base 203 thus allowing seat 201 to be supported by seat base 203 at the lowest position. Next, the user sets the angle of seat back 202 to 45°. Next, the user: 1) Removes fifth and sixth through pins 111 and 113 thus allowing rotary resistance unit 302 to be positioned slightly above the level of seat 201 and in close proximity to vertical pole 101; and, 2) Replaces fifth and sixth through pins 111 and 113. Next, the user adjusts the tension on rotary resistance unit 302 to the desired level. Next, the user attaches two resistance bands 400 associated with the aforementioned gripping loop 403 to a location on vertical pole 101 above rotor support arm support sleeve 110. Next the user grips the gripping loop 403 attached to both resistance bands 400, reclines on seat 201, and places his feet on the aforementioned combination handle/pedals 308 such that retaining strap 309 is positioned over the top of the user's foot. The user then exercises the muscles of his legs, buttocks, arms, and back by pedaling resistance wheel 305 while rhythmically stretching resistance bands 400.

Figure 4:
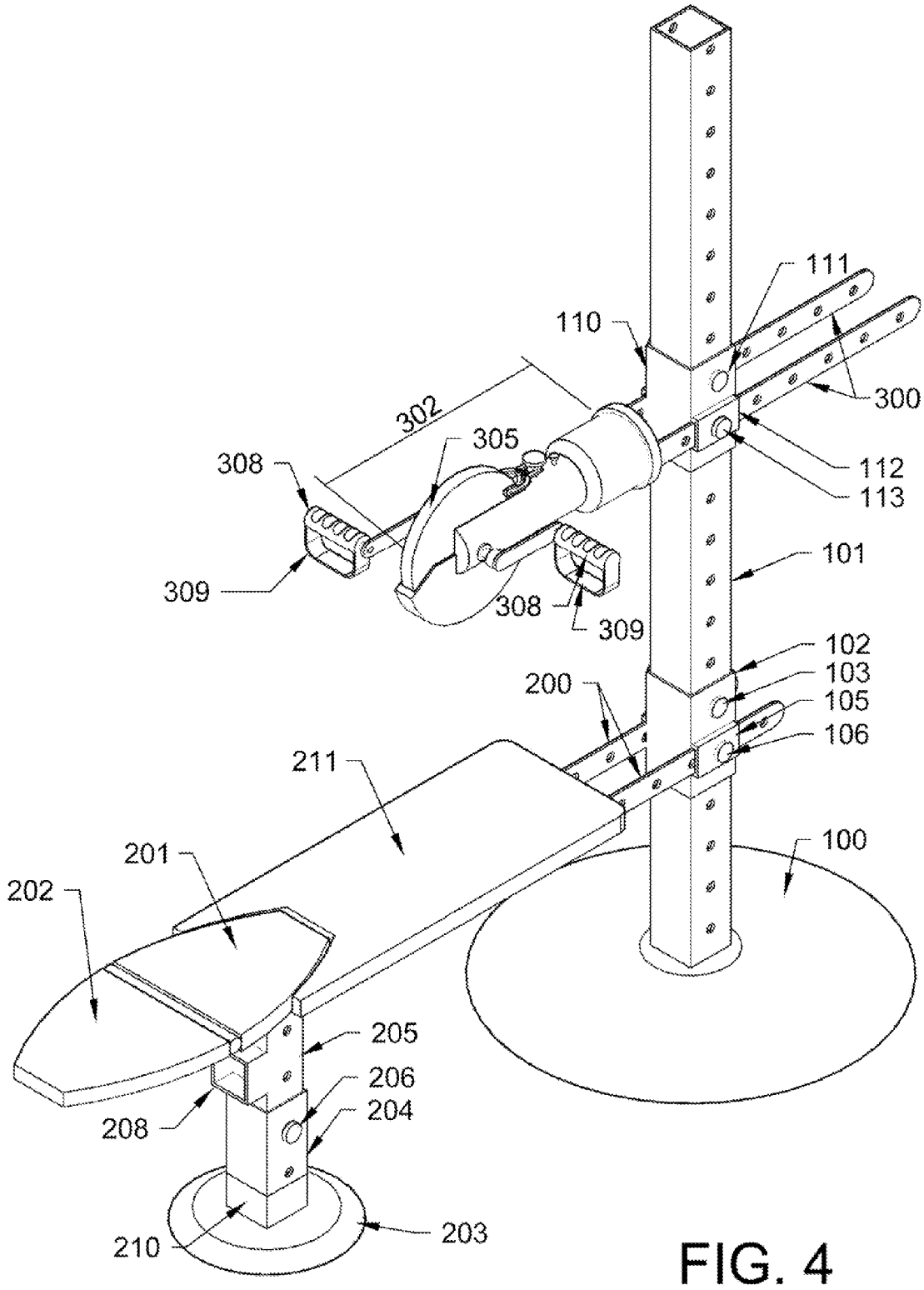
FIG. 4 is an oblique view of the present invention assembled and configured in a third exercise position in which the user lies supine on the present invention.

Referring specifically to FIGS. 2 and 4, to use the machine in a supine position, the user places one of the aforementioned combination handle/pedals 308 or alternative handles 310 on each of said axle bars. Next, the user places seat extension board 211 on top of seat support arms 200 between seat 201 and seat support arm support sleeve 102. Seat extension board 211 has longitudinal grooves in its back so that the back of seat extension board 211 slips over the respective top edges of seat support arms 200 and is locked in place. Next, the user folds and locks seat back 202 so that seat 201 and seat back 202 form a 180° angle abutting into, and at the same height, as seat extension board 211. Next, the user places seat support arm support sleeve 102, seat support arms 200, seat 201, and seat extension board 211 to a height where the soles of the user's feet rest solidly on the ground when the user lies on his or her back on seat 201 and seat extension board 211. The user does this by: 1) Removing the first and second through pins 103 and 106 thus allowing seat 201 to be raised to a comfortable height; 2) Replacing first and second through pins 103 and 106; 3) Unpinning and positioning the aforementioned swinging, telescoping seat tube 205 and seat base tube 204 in the down position (if not already down); 4) Adjusting the length of seat base tube 204 and a telescoping seat tube 205 to the proper length to support seat 201, and, 5) Placing seat base tube 204 perpendicularly down over the mounting flange of base tube mounting sleeve 210 to attach seat base tube 204 to seat base 203 thus allowing seat 201 and seat extension board 211 to be supported by seat base 203. Next, the user: 1) Removes fifth and sixth through pins 111 and 113 thus allowing rotary resistance unit 302 to be positioned approximately 18" above the user's shoulders when lying on seat 201 and seat extension board 211; and, 2) Replaces fifth and sixth through pins 111 and 113. Next, the user adjusts the tension on rotary resistance unit 302 to the desired level. Next the user lies on his or her back on seat 201 and seat extension board 211, places the soles of his or her feet securely on the floor, and grips combination handle/pedals 308. The user then exercises the muscles of his arms, shoulders, chest, and back by rotating resistance wheel 305.

Figure 5:
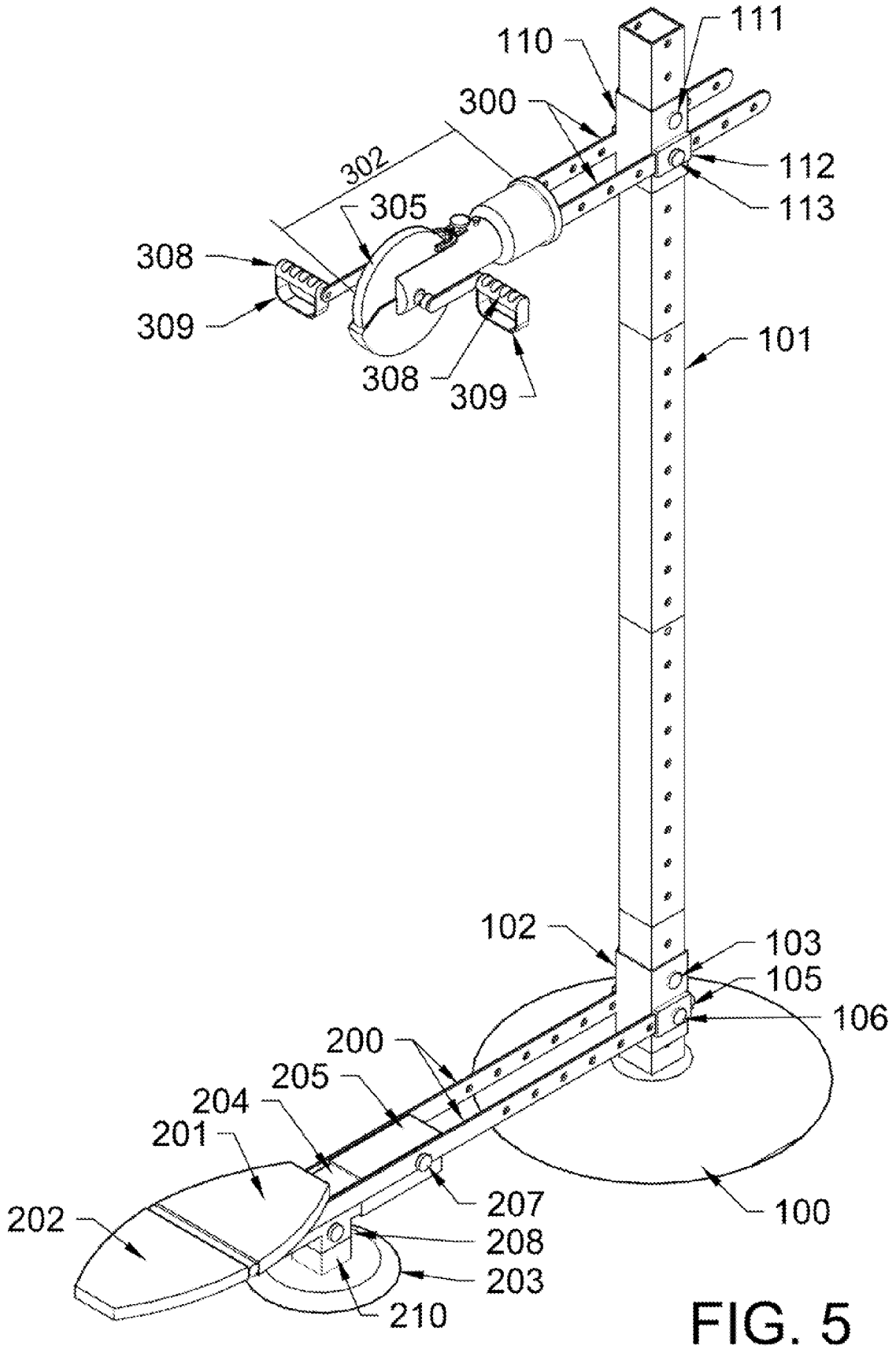
FIG. 5 is an oblique view of the present invention assembled and configured in a fourth exercise position in which the user stands to use the present invention.

Referring specifically to FIGS. 2 and 5, to use the machine in a standing position, the user places one of the aforementioned combination handle/pedals 308 or alternative handles 310 on each of said axle bars 307. Next, the user drops seat support arm support sleeve 102, seat support arms 200, and seat 201 to their lowest position by: 1) Positioning and pinning the aforementioned swinging, telescoping seat tube 205 and seat base tube (not shown) up and out of the way into the space between the aforementioned parallel seat support arms 200 (if not already stowed); 2) Removing first and second through pins 103 and 106 thus allowing seat 201 to be lowered to the level of base unit 203; 3) Replacing first and second through pins 103 and 106; and, 4) Placing seat base sleeve 208 perpendicularly down over the mounting flange of base tube mounting sleeve 210 to attach seat base tube (not shown) to seat base 203 thus allowing seat 201 to be supported by seat base 203. Next, the user sets the angle of seat back 202 to 180° with respect to seat base 201. Next, the user: 1) Removes the fifth and sixth through pins 111 and 113 thus allowing rotary resistance unit 302 to be positioned at a height above the user's head when standing; and, 2) Replaces fifth and sixth through pins 111 and 113. Next, the user adjusts the tension on rotary resistance unit 302 to the desired level. Next the user stands and straddles seat support arms 200 with his feet and reaches up to grasp combination handle/pedals 308. The user then exercises the muscles of his arms, shoulders, and chest by rotating resistance wheel 305.

While the invention has been described in connection with what are considered to be the most practical and preferred embodiments, it is to be understood that the invention is not to be limited to the disclosed embodiments but on the contrary is intended to cover various modifications and equivalent arrangements included within the spirit and scope of the disclosure.

Further, such exercise equipment is routinely equipped with incidental non-essential accessories, such as: 1) Cooling fans; 2) Water bottle/drink holders; 3) Music reproducing equipment; 4) Timers or other devices for logging the amount of time the user uses the machine; 5) Performance data measuring and display devices for measuring the amount of energy expended or calories consumed by the user when using the machine; 6) Physiological data measuring and display devices for measuring the user's heart rate and blood pressure when using the machine; and so on, and all such minor variations are included in the spirit and scope of the present invention.

What is claimed is:

1. A rotary arm/leg exerciser, comprising:

a) a base unit with a vertical pole mounted perpendicularly to said base unit;

b) a first support sleeve adapted to support a pair of seat support arms disposed outside of said vertical pole and slidably displaceable and fixable with respect to said vertical pole further comprising horizontally disposed first mounting channels adapted to mount said seat support arms affixed on opposing lateral sides of said first support sleeve adapted to support a seat support arm;

c) the pair of horizontally disposed seat support arms each with a proximal end and a distal end, the proximal ends of which are slidably displaceable through, and fixable with respect to, one of said first mounting channels adapted to mount said seat support arms;

d) a seat with a fixedly reclinable back affixed to the distal ends of said seat support arms;

e) a telescopically lengthwise adjustable seat support unit hingedly attached between said seat support arms such that said seat support unit is adapted to be swung down and fixed in a first position in which the long axis of said seat support unit is perpendicular to said seat support arms to support said seat, or swung up and fixed in a second position in which the long axis of said seat support unit is parallel to said seat support arms and between them;

f) a second support sleeve adapted to support a pair of rotor support arms disposed outside of said vertical pole and slidably displaceable and fixable with respect to said vertical pole with horizontally disposed second mounting channels adapted to mount said rotor support arms affixed on opposing lateral sides of said second support sleeve adapted to support rotor support arms;

g) the pair of horizontally disposed rotor support arms each with a proximal end and a distal end, the proximal ends of which are slidably displaceable through, and fixable with respect to, one of said second mounting channels adapted to mount said rotor support arms;

h) a rotary resistance unit comprising a resistance wheel with an axle mounted between, and supported by, two arms of a support yoke wherein the non-bifurcated end of said support yoke is co-axially affixed to a support head;

a. wherein said resistance wheel further comprises a pair of diametrically opposed crank arms each with a proximal end and a distal end, wherein the proximal end of one crank arm is orthogonally affixed at one end of said axle and the proximal end of the other crank arm is orthogonally affixed at the other end said axle, wherein the distal ends of both crank arms are connectable with a one of a multiplicity of interchangeable handles and pedals;

b. wherein said support head is affixed to the distal ends of said rotor support arms; and i) a user adjustable means of varying a force required to rotate said resistance wheel.

2. A rotary arm/leg exerciser of claim 1, wherein said support yoke is rotatably fixable with respect to said head and attached rotor support arms such that the plane described by said resistance wheel is fixable at any angle with respect to the plane described by said rotor support arms.

3. A rotary arm/leg exerciser of claim 1, further comprising a seat extension board, wherein said seat extension board is adapted to be placed longitudinally on top of said seat support arms such that said seat extension board is coplanar with said seat.

4. A rotary arm/leg exerciser of claim 1, wherein a multiplicity of resistance bands are adapted to be attached at various positions along the length of said vertical pole.

* * * * *